US011537084B2

(12) United States Patent
Schenk et al.

(10) Patent No.: US 11,537,084 B2
(45) Date of Patent: Dec. 27, 2022

(54) ELECTRONIC WATCH WITH A SOLAR CELL

(71) Applicant: ETA SA Manufacture Horlogere Suisse, Grenchen (CH)

(72) Inventors: Marc Schenk, Le Landeron (CH); Martin Jufer, Melchnau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 289 days.

(21) Appl. No.: 17/065,658

(22) Filed: Oct. 8, 2020

(65) Prior Publication Data

US 2021/0132547 A1 May 6, 2021

(30) Foreign Application Priority Data

Nov. 4, 2019 (EP) ..... 19206954

(51) Int. Cl.
*G04C 10/02* (2006.01)
*G04C 3/00* (2006.01)
*G04C 3/16* (2006.01)

(52) U.S. Cl.
CPC ..... *G04C 10/02* (2013.01); *G04C 3/008* (2013.01); *G04C 3/16* (2013.01)

(58) Field of Classification Search
CPC ..... G04C 10/02; G04C 3/008; G04C 3/16; G04C 3/00; G04B 19/10; G04B 19/14
See application file for complete search history.

(56) References Cited

U.S. PATENT DOCUMENTS 1,074,976 A * 10/1913 Porter ..... G04B 19/14 368/300
1,400,421 A * 12/1921 Colomb ..... G04B 19/14 968/157

(Continued)

FOREIGN PATENT DOCUMENTS

CN 101482731 A 7/2009
CN 102681420 A 9/2012

(Continued)

OTHER PUBLICATIONS

Through—dictionary.com Sep. 18, 2022.*

(Continued)

*Primary Examiner* — Sean Kayes
(74) *Attorney, Agent, or Firm* — Oblon, McClelland, Maier & Neustadt, L.L.P.

(57) ABSTRACT

A timepiece movement includes a photovoltaic cell which is attached to the upper surface of a support plate, preferably by adhesive bonding. On the other side of the cell, on its lower surface, the support plate is provided with a plurality of nuts. An electrical module including a flat surface is attached to the support plate with the nuts. The module is provided with several openings whose position and dimensions correspond to those of the nuts, so that the nuts pass through the openings, allowing the flat surface of the module to be placed in contact with the support plate. The module is secured to the support plate by screws, screwed into the nuts. The connection via the nuts secures the photovoltaic cell to the electrical module and ensures shock resistance, without requiring a lateral support.

10 Claims, 6 Drawing Sheets

(56) References Cited

U.S. PATENT DOCUMENTS

| | | | | | |
|---|---|---|---|---|---|
| 1,766,806 | A * | 6/1930 | Wilcox, Jr. | G04B 37/0409 968/312 |
| 1,995,036 | A * | 3/1935 | Pape | G04B 19/14 968/157 |
| 2,196,998 | A * | 4/1940 | Lodge | G04B 19/10 968/153 |
| 4,064,552 | A * | 12/1977 | Angelucci | H05K 1/189 968/878 |
| 4,276,629 | A | 6/1981 | Matsumura et al. | |
| 4,291,401 | A * | 9/1981 | Bachmann | G04B 19/14 968/157 |
| 4,421,423 | A * | 12/1983 | Lederrey | G04B 37/116 968/301 |
| 4,666,313 | A | 5/1987 | Ganter et al. | |
| 4,740,931 | A * | 4/1988 | Graves | G04B 19/26 968/207 |
| 6,392,963 | B1 * | 5/2002 | McGinnis-Smith | G04C 17/0075 368/107 |
| 2006/0153011 | A1 * | 7/2006 | Osa | G04C 10/02 368/205 |
| 2013/0148484 | A1 * | 6/2013 | Jeanrenaud | G04B 19/12 368/232 |
| 2018/0173162 | A1 * | 6/2018 | Hurni | G04D 3/0048 |

FOREIGN PATENT DOCUMENTS

| | | | | |
|---|---|---|---|---|
| CN | 103163774 | A | | 6/2013 |
| CN | 105143998 | A | | 12/2015 |
| CN | 110286581 | A | | 9/2019 |
| CN | 110231771 | B | * | 3/2022 |
| JP | 62-123388 | A | | 6/1987 |
| JP | 8-166469 | A | | 6/1996 |
| JP | 11-118952 | A | | 4/1999 |
| JP | 2000-329864 | A | | 11/2000 |
| KR | 10-1992-0001282 | A | | 1/1992 |

OTHER PUBLICATIONS

Chinese Office Action dated Sep. 24, 2021 in Chinese Patent Application No. 202011216480.7, citing documents AO through AV therein, 7 pages.

Korean Office Action dated Apr. 4, 2022 in Korean Patent Application No. 10-2020-0139191 (with English translation), citing documents AO therein, 12 pages.

Notice of the Reason for Refusal dated Oct. 19, 2021 in Japanese Patent Application No. 2020-177794 (with English language translation), citing document AO therein, 5 pages.

European Search Report dated Apr. 30, 2020 in European Application 19206954.0 filed Nov. 4, 2019 (with English Translation of Categories of Cited Documents & Written Opinion), citing documents AA-AB therein, 8 pages.

* cited by examiner

ELECTRONIC WATCH WITH A SOLAR CELL

CROSS-REFERENCE TO RELATED APPLICATION

This application claims priority to European Patent Application No. 19206954.0 filed on Nov. 4, 2019, the entire disclosure of which is hereby incorporated herein by reference.

FIELD OF THE INVENTION

The present invention relates to an electronic watch provided with a photovoltaic cell.

STATE OF THE ART

Electronic watches with a photovoltaic cell are well known. The cell is mounted under the watch crystal, so that the cell can capture photovoltaic energy while the watch is worn. The solar energy is converted into electrical energy to power the electrical and electronic watch components, such as a motor for moving hands and/or a rechargeable battery.

The photovoltaic cells used in certain types of high-end watches consist of a fragile substrate, often made of glass, which carries layers of semiconductor material. The substrate must withstand the stresses induced during assembly and over the life cycle of the watch. Shock resistance is particularly important.

Japanese Patent Nos. JPH11118952 and JP427580 disclose watches wherein a photovoltaic cell is held in contact with a motor module of the watch by an annular lateral support. As the lateral support is limited to the periphery of the cell, the risk of the cell and the motor module coming apart during shocks remains significant. Further, the lateral support is a component which complicates the construction of the watch, and which can make disassembly difficult. Japanese Patent No JPH08166469 describes the fabrication of layers of a photovoltaic cell on a metal substrate to make a watch dial with the cell integrated in the dial. However, this solution still requires means to secure the dial laterally. Moreover, this solution is not suitable for the most common case in which a prefabricated photovoltaic cell is integrated during the watch movement assembly process.

SUMMARY OF THE INVENTION

It is an object of the present invention to provide an electronic watch with a photovoltaic cell which does not suffer from the drawbacks described above. This object is achieved by a timepiece movement and by a watch according to the annexed claims.

A timepiece movement according to the invention comprises a photovoltaic cell which is fixed to the upper surface of a support plate, for example by adhesive bonding. On the other side of the cell, on the lower surface thereof, the support plate is provided with a plurality of nuts. An electrical module having a flat surface is attached to the support plate by means of the nuts. The module is provided with several openings whose position and dimensions correspond to those of the nuts, so that the nuts pass through the openings, allowing the flat surface of the module to be placed in contact with the support plate. The module is secured to the support plate by screws, screwed into the nuts. The connection via the nuts secures the photovoltaic cell to the electrical module and ensures shock resistance, without requiring a lateral support. The connection is easy to assemble and disassemble. Preferably, a number of nuts are positioned close to the centre of the support plate, thereby preventing the module and the cell coming apart, which further increases the resistance of the assembly in the event of shock.

Other features and advantages of the present invention will appear in the following description of preferred embodiments, given by way of non-limiting example, with reference to the annexed drawings.

DETAILED DESCRIPTION OF EMBODIMENTS OF THE INVENTION

Figure 1:
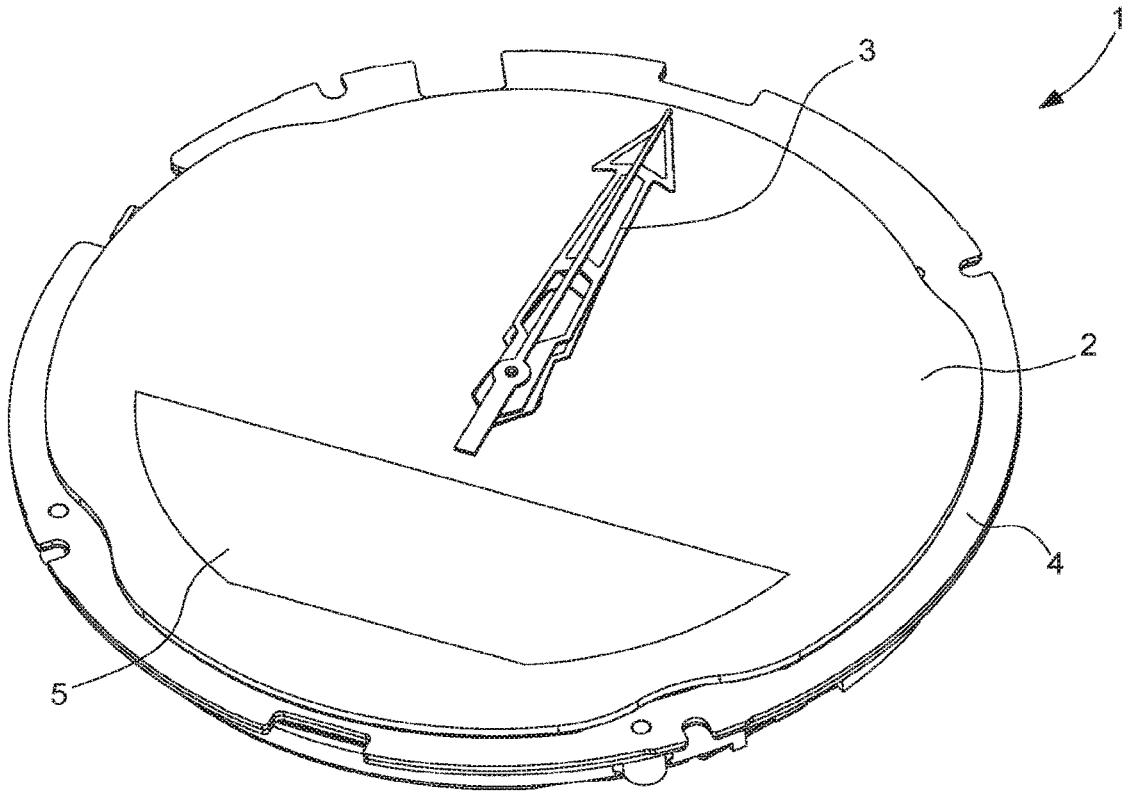
FIG. 1 represents a timepiece movement for an electronic watch with a photovoltaic cell according to one embodiment of the invention.

The movement 1 represented in FIG. 1 comprises a photovoltaic cell 2 mounted below the hands 3 of the watch to be assembled, and secured to the upper surface of a rigid support plate 4. Movement 1 further includes a digital screen 5. FIG. 2*a* represents support plate 4 according to this particular embodiment. According to the invention, the plate is provided with a plurality of nuts 6 which are secured to the lower surface of plate 4, i.e. the surface opposite the surface to which photovoltaic cell 2 will be fixed. The nuts are preferably cylindrical nuts. Nuts 6 may be fixed to plate 4 by welding or adhesive bonding, depending upon the material of plate 4. This material can be a metal material. The specific plate 4 represented in FIG. 2*a* is provided with a window 7 for the digital screen, with a central hole 8 for the passage of the rotating hand arbors, and with several openings and notches. Round notches 10 will serve as mounting points for the movement in a case middle (see below), and openings 11 will receive the screw heads of the motor module (also see below). Rectangular notches 12 will serve as a passage for electrical connection strips and/or as an alignment marker for the movement in a watch case middle.

Figure 2A:
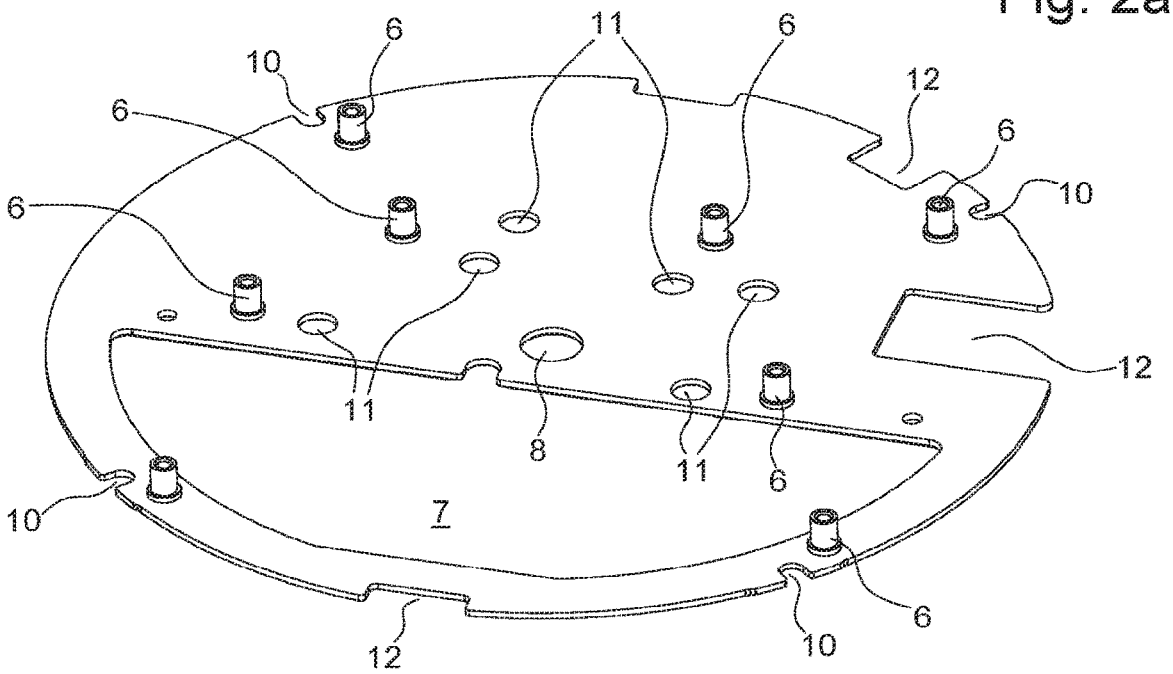
FIGS. 2*a* to 2*k* represent various steps of the method of assembling a movement and a watch according to one embodiment of the invention.
Figure 2B:
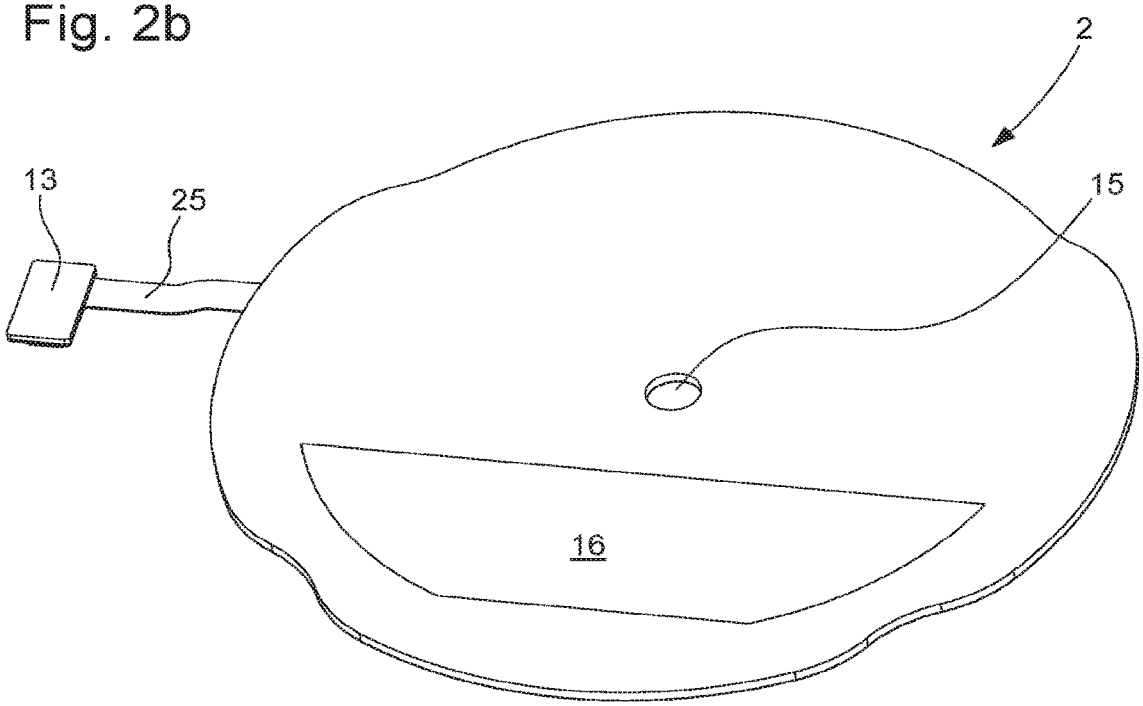

FIG. 2*b* shows the photovoltaic cell 2 prior to assembly to rigid plate 4. The cell comprises a glass substrate having thin layers (thin film) made of semiconductor material (not represented). The substrate is bonded by an electro-conductive adhesive to an FPC (flexible printed circuit), comprising a connector 13, for example by a flexible electrical connection 25. In the present context, the whole of the substrate and the FPC is considered to be photovoltaic cell 2. Cell 2 has a central hole 15 for the passage of the rotating hand arbors, together with a window 16 for the digital screen.

Figure 2C:
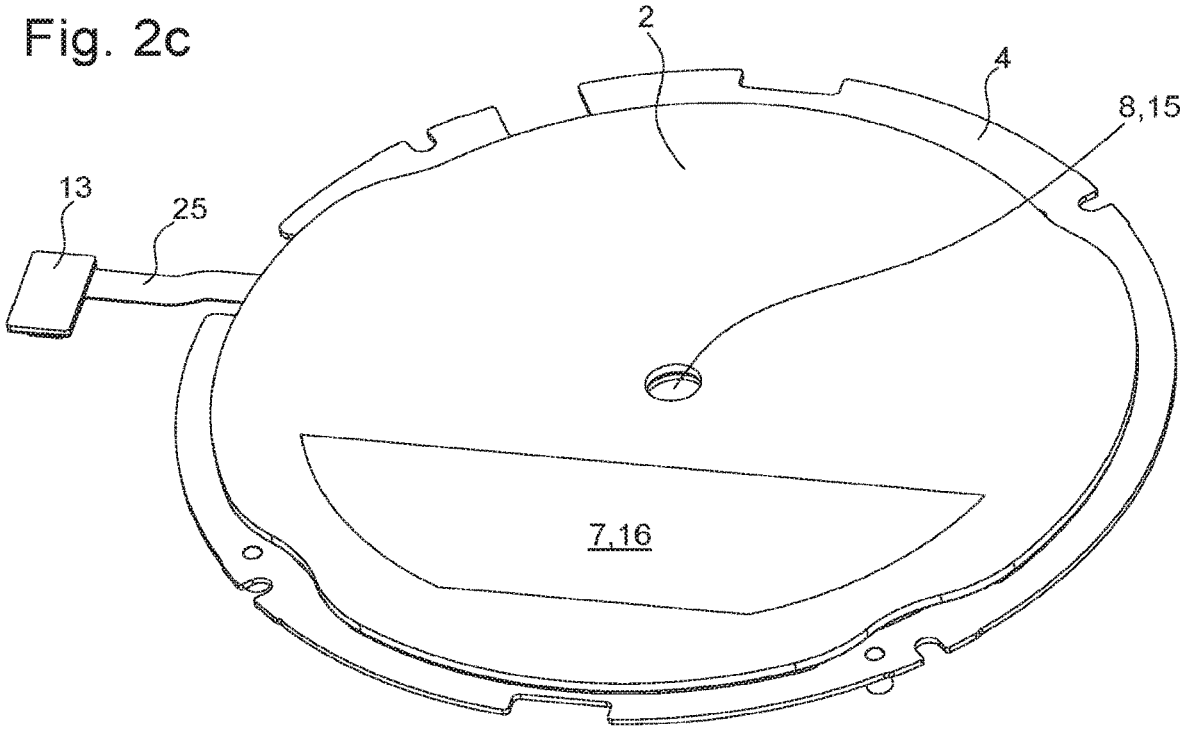

As illustrated in FIG. 2*c*, cell 2 is bonded to the upper surface of support plate 4, preferably by a double-sided adhesive layer, laminated on plate 4. Cell 2 is centred on plate 4, so that central openings 8 and 15 and windows 7 and 16 are aligned with respect to one another. Flexible connection 25 with connector 13 is positioned at the height of one of rectangular notches 12 provided on the periphery of plate 4.

Figure 2D:
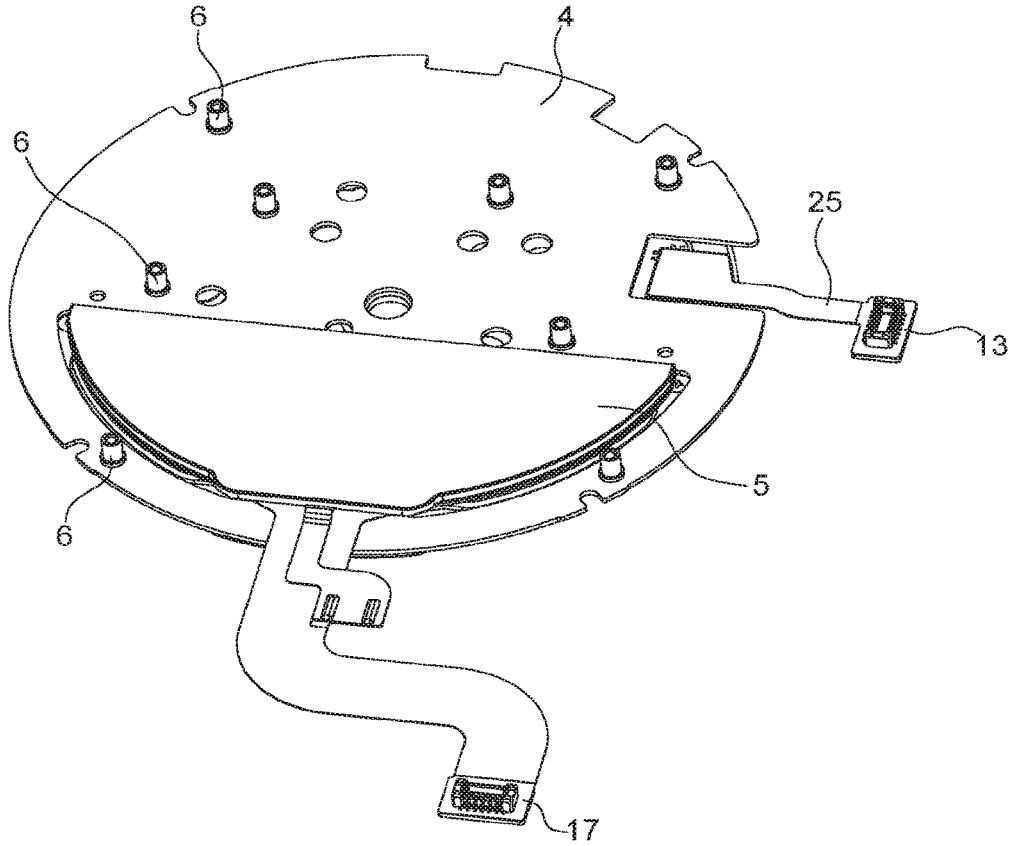

FIG. 2*d* represents the mounting of digital screen 5 in the opening created by windows 7 and 16. Screen 5 can be made as an assembly of known electronic components, such as an MIP (memory-in-pixel) layer, and a backlighting layer, provided with a connector 17.

Figure 2E:
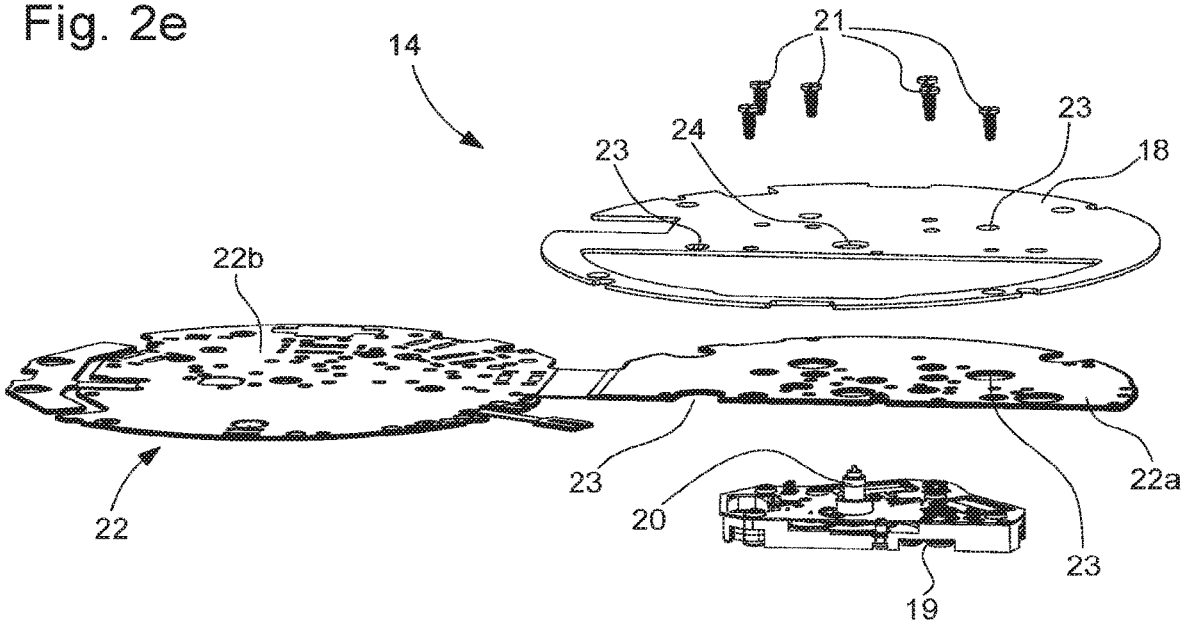
Figure 2F:
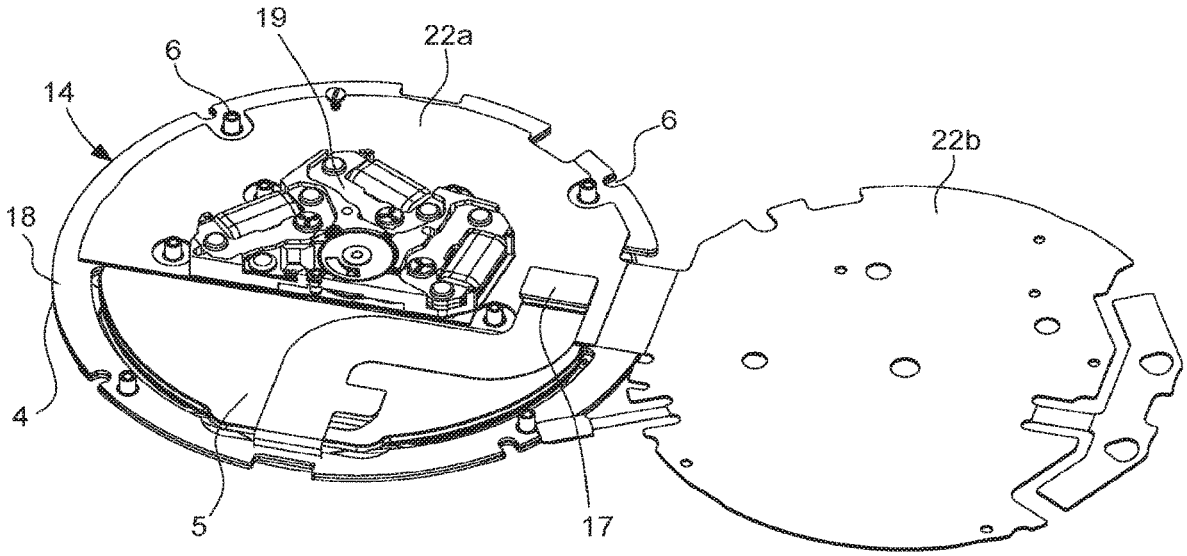
Figure 2G:
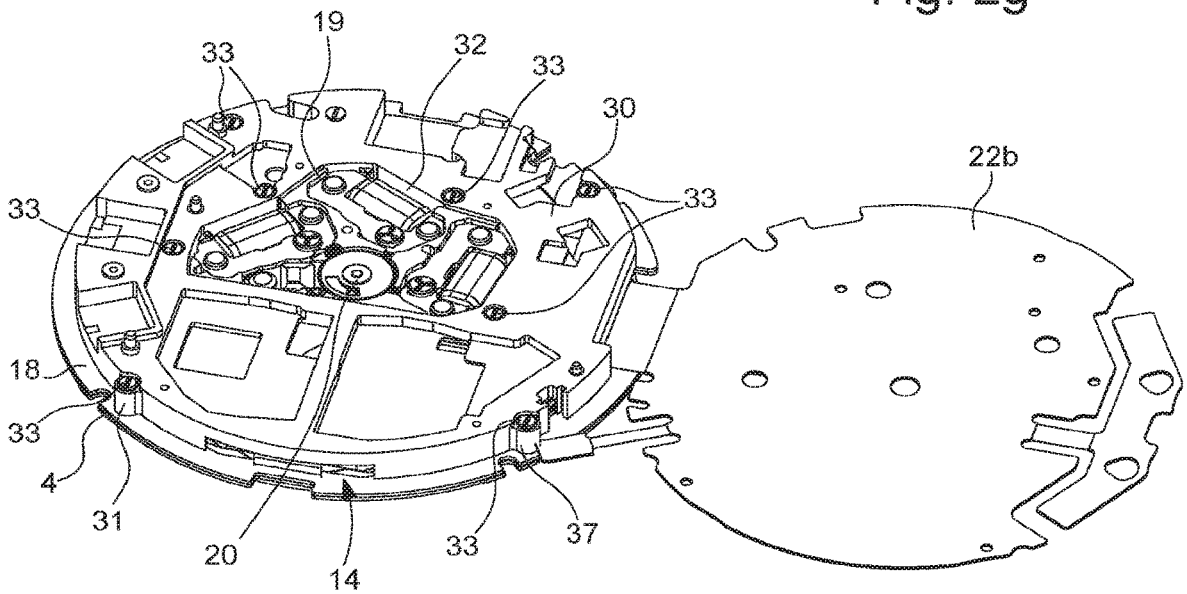

FIG. 2*e* represents the assembly of motor module 14 of the movement of FIG. 1. A second rigid support plate 18 is provided, which has the same circumference as the photovoltaic cell support plate 4. Like support plate 4, the second plate 18 can be a metal plate. An electrical motor 19 provided with rotating arbors 20 for hands 3 is attached centrally to the second support plate 18 by screws 21, with a first portion 22*a* of a printed circuit board (PCB) 22 mounted between motor 19 and second plate 18. PCB 22 includes a second portion 22*b* which can be folded over onto first portion 22*a* mounted between motor 19 and second plate 18. Second plate 18 and first portion 22*a* of the PCB are provided with openings 23 aligned with each other (which make a single opening when the module is assembled), which respectively correspond to nuts 6 of first support plate 4, so that the flat surface of second plate 18 is positioned in contact with the lower surface of first support plate 4 on which nuts 6 are mounted. In other words, openings 23 are positioned and dimensioned so that nuts 6 pass through these openings 23, so that the two plates 4 and 18 can be positioned back-to-back, see FIG. 2*f*. The heads of screws 21 will be housed inside openings 11 provided in support plate 4. Second plate 18 comprises a central hole 24 aligned with central holes 8 and 15 in cell 2 and in first support plate 4, when the two plates 4 and 18 are assembled. The central holes aligned with each other allow access to the rotating arbors 20 of motor 19, on the upper side of the assembly.

Figure 2H:
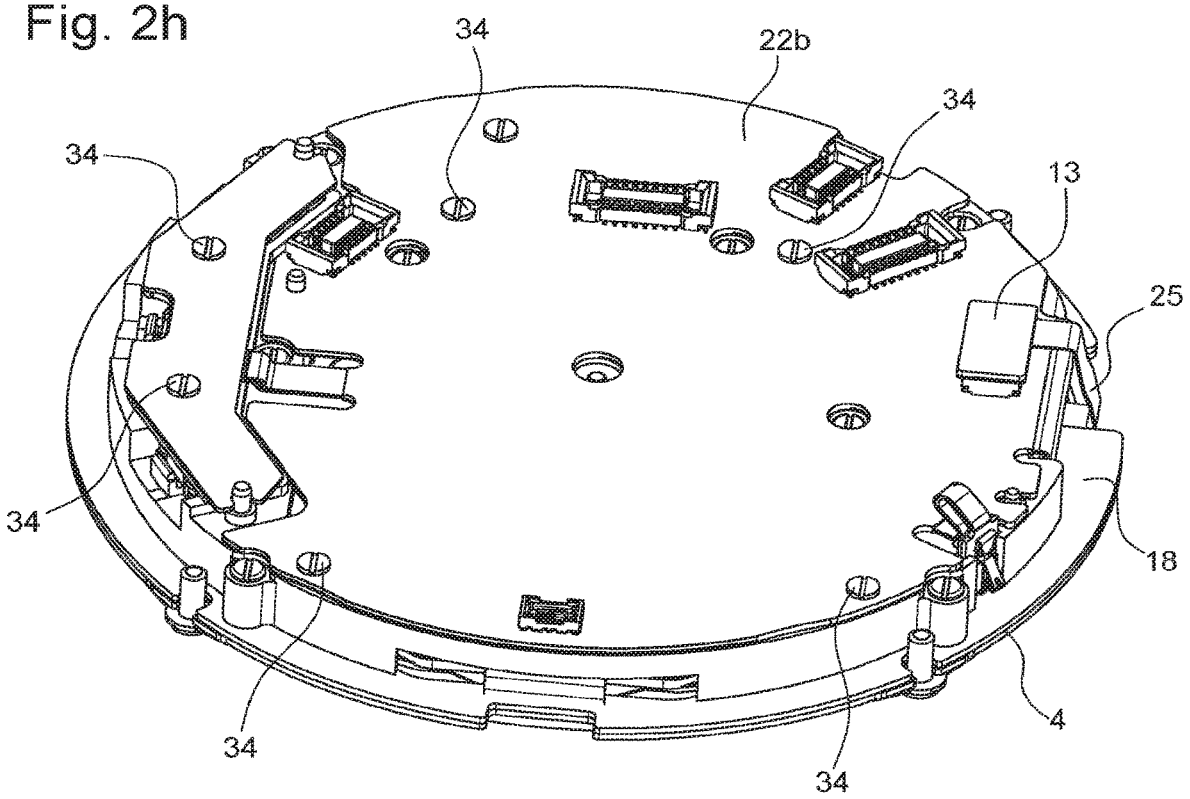

Connector 17 of screen 5 is plugged into a socket provided in first portion 22*a* of PCB 22. A spacer 30 is then positioned on said first portion 22*a* of the PCB (FIG. 2*b*). Spacer 30 is also provided with openings 31 for the passage of nuts 6, in addition to a cavity 32 dimensioned to accommodate motor 19, so that spacer 30 can be installed in contact with first portion 22*a* of the PCB. Spacer 30 and motor module 14 are then secured to support plate 4 by screws 33 screwed into nuts 6. The folding portion 22*b* of the PCB is now folded over to cover spacer 30 and secured by screws 34 (FIG. 2*h*). Connector 13 of the photovoltaic cell is plugged into a socket of PCB 22. Once hands 3 are mounted, the assembly of movement 1 represented in FIG. 1 is complete.

Figure 2I:
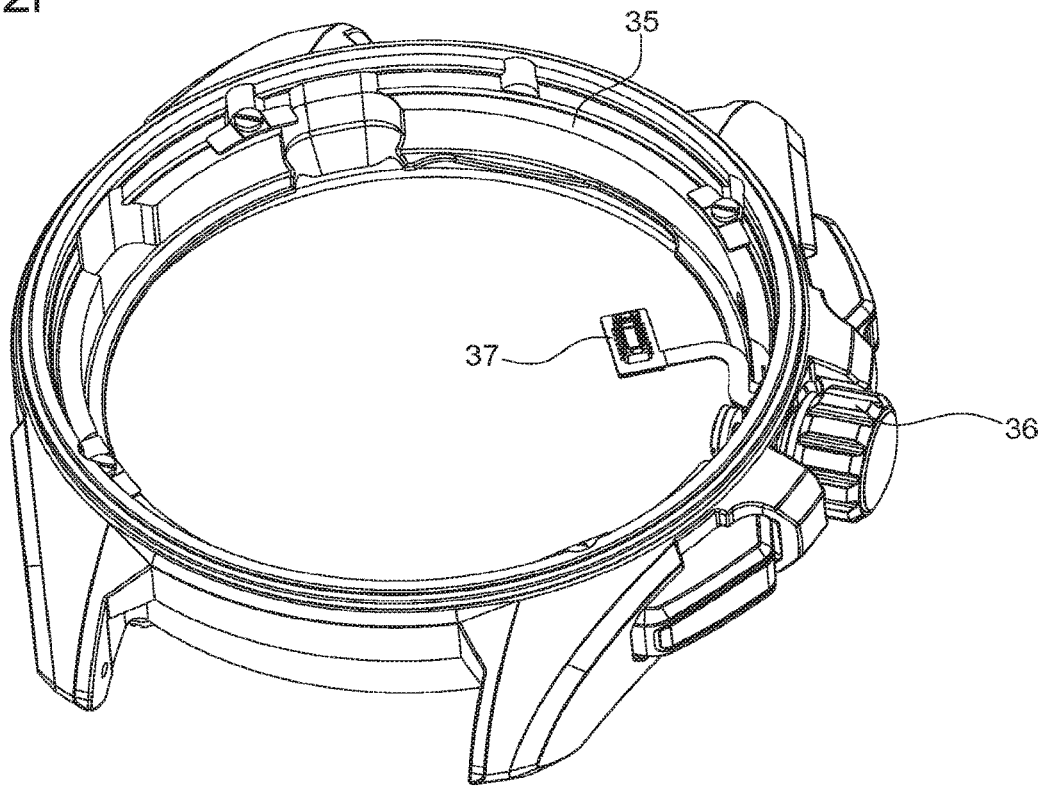
Figure 2J:
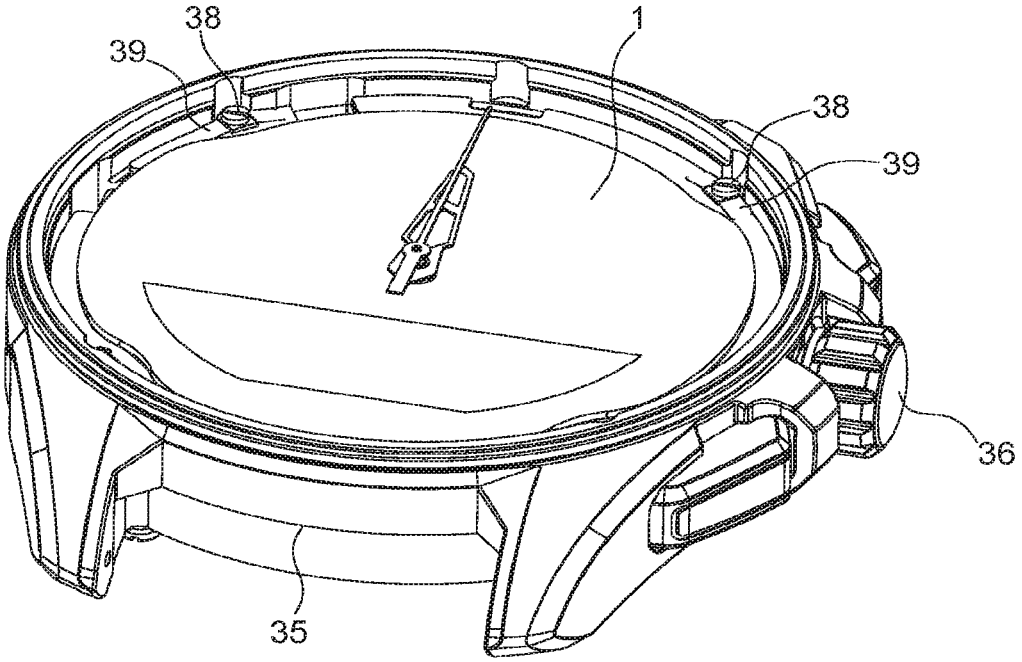
Figure 2K:
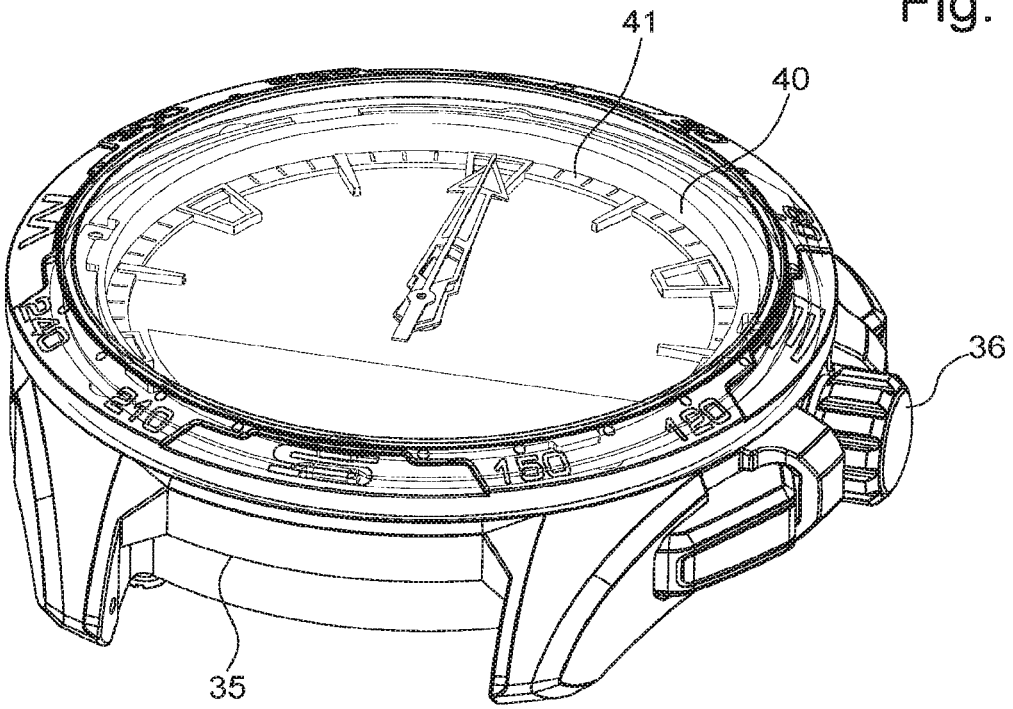

This movement is then installed in the case middle 35 of a watch (see FIGS. 2*i* and 2*j*). Case middle 35 includes the watch crown 36 connected to a connector 37 which will be plugged into a socket of PCB 22. The assembly of the two plates 4 and 18 is attached to case middle 35 by screws 38 and flanges 39, with screws 38 screwed into round notches 10 at the periphery of plates 4 and 18. The assembly of the watch is completed by mounting an indexing ring 40 and a bezel 41 (FIG. 2*k*).

The invention is not limited to the embodiment represented in the Figures. For example, the invention also covers embodiments which are not provided with a digital screen 5. Photovoltaic cell 2, motor 19, PCB 22 and case middle 34 can be made according to any one of several embodiments known in the state of the art. The motor module is simply an example of an electrical module that can be used in a watch according to the invention. Other modules that can be used for a digital watch (without hands) according to the invention do not have a motor, but only microelectronic components. To be able to be used in the invention, the electrical module 14 only needs to have a flat surface, to be installed against the lower surface of support plate 4. According to the embodiment of the Figures, the 'flat surface' is the surface of plate 18 which is opposite to the surface to which motor 19 is attached. Further, and in general, the electrical module must be provided with openings which allow the passage of nuts 6. In the case of the embodiment of the Figures, openings 23 pass through second plate 18 and the first portion of PCB 22.

In any embodiment according to the invention, nuts 6 allow the assembly of a timepiece movement to a photovoltaic cell without requiring a lateral support. The assembly is easy to disassemble by loosening screws 33. According to preferred embodiments, and as is also the case in the embodiment represented in the Figures, nuts 6 are positioned in a specific manner on the surface of support plate 4. A first group of nuts is situated in proximity to the periphery of plate 4, and a second group is situated more centrally on the plate, in proximity to motor 19, when motor module 14 is assembled to support plate 4. The central nuts will improve the security of the assembly comprising support plate 4 and motor module 14, and prevent these components coming apart in the event of shock. This also reduces the risk of the hands coming loose, which makes it possible to machine a central hole in the cell as close as possible to the diameter of the hour hand pipe to optimise the aesthetics of the watch face.

The invention claimed is:

1. An electronic watch movement comprising a photovoltaic cell and an electrical module, said module comprising a flat surface, wherein:

the movement further comprises a first rigid support plate, the photovoltaic cell is fixed to the upper surface of the support plate, the support plate is provided with a plurality of nuts mounted on the lower surface thereof, the flat surface of the electrical module is mounted in contact with said lower surface of the support plate, the electrical module being provided with a plurality of openings whose position and dimensions correspond to those of the nuts, so that the nuts pass through the openings, the electrical module and the support plate are secured to each other by a plurality of screws, screwed into the nuts.

2. The timepiece movement according to claim 1, wherein a first group of nuts is positioned in proximity to the periphery of the support plate, and a second group of nuts is positioned more centrally with respect to the periphery than the first group.

3. The timepiece movement according to claim 1, wherein the electrical module comprises a second support plate provided with said openings, and wherein the flat surface of the electrical module is one of the surfaces of the second support plate which is positioned back-to-back with respect to the first support plate.

4. The timepiece movement according to claim 3, wherein the first and second support plates have identical circumferences.

5. The timepiece movement according to claim 3, comprising a spacer positioned on the second support plate on the opposite side to the photovoltaic cell, and also provided with openings which allow the passage of the nuts, so that the spacer and the two support plates are secured to each other by the screws screwed into the nuts.

6. The timepiece movement according to claim 3, comprising hands, and wherein the electrical module includes an electrical motor mounted on the second support plate on the other side of the first support plate, the motor comprising the rotating hand arbors which are accessible through central holes aligned with each other, said holes being respectively provided in the photovoltaic cell and in the two support plates.

7. The timepiece movement according to claim 6, comprising a spacer provided with a cavity which can accommodate the motor.

8. The timepiece movement according to claim 1, further comprising a digital screen and wherein the first support plate is provided with a window adapted to the dimensions of the screen.

9. An electronic watch according to claim 1, wherein the photovoltaic cell includes a substrate made of glass or another fragile material.

10. An electronic watch comprising a case middle wherein a movement according to claim 1 is installed.

* * * * *